US006659628B2

(12) United States Patent
Gomez Del Campo

(10) Patent No.: US 6,659,628 B2
(45) Date of Patent: Dec. 9, 2003

(54) ENHANCEMENTS FOR A SUSPENSION, COUPLING AND ALIGNMENT SYSTEM AND PASSAGE FOR ELECTRICAL ENERGY CABLES FOR FLUORESCENT LUMINAIRES

(76) Inventor: Juan Cordero Gomez Del Campo, Calzada de los Leones No. 256-2do. Piso, Col. Alpes, 01010, Mexico City, D.F (MX)

( * ) Notice: Subject to any disclaimer, the term of this patent is extended or adjusted under 35 U.S.C. 154(b) by 0 days.

(21) Appl. No.: 09/951,779

(22) Filed: Sep. 14, 2001

(65) Prior Publication Data

US 2002/0036906 A1 Mar. 28, 2002

(30) Foreign Application Priority Data

Sep. 14, 2000 (MX) ..... 009034

(51) Int. Cl.[7] ..... F21V 21/00

(52) U.S. Cl. ..... 362/391; 362/226; 362/219; 362/457

(58) Field of Search ..... 362/219, 224, 362/226, 370, 374, 391, 407, 457

(56) References Cited

U.S. PATENT DOCUMENTS

| | | | | | |
|---|---|---|---|---|---|
| 4,420,798 | A | * | 12/1983 | Herst et al. | 362/145 |
| 5,183,327 | A | * | 2/1993 | Fabbri | 362/219 |
| 5,221,138 | A | * | 6/1993 | Bostjancic et al. | 362/147 |
| 5,658,066 | A | * | 8/1997 | Hirsch | 362/219 |
| 6,290,375 | B1 | * | 9/2001 | LeVasseur | 174/50 |
| 6,530,674 | B2 | * | 3/2003 | Grierson et al. | 362/219 |

* cited by examiner

*Primary Examiner*—Sandra O'Shea
*Assistant Examiner*—John Anthony Ward
(74) *Attorney, Agent, or Firm*—Arent Fox Kintner Plotkin & Kahn PLLC

(57) ABSTRACT

A suspension, coupling and alignment system and an electrical energy cables passage for fluorescent luminaires, comprising a luminaire body provided in its upper face with a longitudinal chute and a juncture element for the mounting of the adjacent luminaires, wherein said juncture element has end bores, mating with the bores provided in the lower face of said chute, in order to fix and mount a coupling for the luminaire suspension, said juncture element has such a configuration and dimensions that it can be inserted and permanently mounted on the end parts of said chute.

5 Claims, 2 Drawing Sheets

ENHANCEMENTS FOR A SUSPENSION, COUPLING AND ALIGNMENT SYSTEM AND PASSAGE FOR ELECTRICAL ENERGY CABLES FOR FLUORESCENT LUMINAIRES

FIELD OF THE INVENTION

The object system of this application solves the problems presented by illumination systems for large areas, particularly when said illumination is carried out by fluorescent luminaires, these systems require a complex and intensive labor due to its construction and design, for the system needs to achieve a tandem alignment of an undetermined number of luminaires, furthermore it is necessary to provide the required means in order to suspend each luminaire from the construction structure, besides, the system needs to have corresponding slopes for the electrical current conduction cables. In addition to the aforementioned problems, it is necessary to suitably align the luminaires line so provided, therefore, making difficult and expensive this kind of installation.

OBJECTS OF THE INVENTION

One object of the present invention is to provide luminaires which facilitate the mounting and alignment thereof over its corresponding structure.

Another object of the invention, is to avoid the conduction cables slope for the electrical current for each one of the luminaires.

An additional object of the invention is the disposition or use of mechanical means which allow the automatic allingment of each and all of the luminaires disposed in a tandem line of said luminaires.

Yet, another object of the invention is to provide a suspension, coupling, and alignment system and a passage for the electrical energy cables for said luminaires in an expedite manner, whereby reducing the human labor for the installation of the illumination system within large areas.

DETAILED DESCRIPTION OF THE INVENTION

Figure 1:
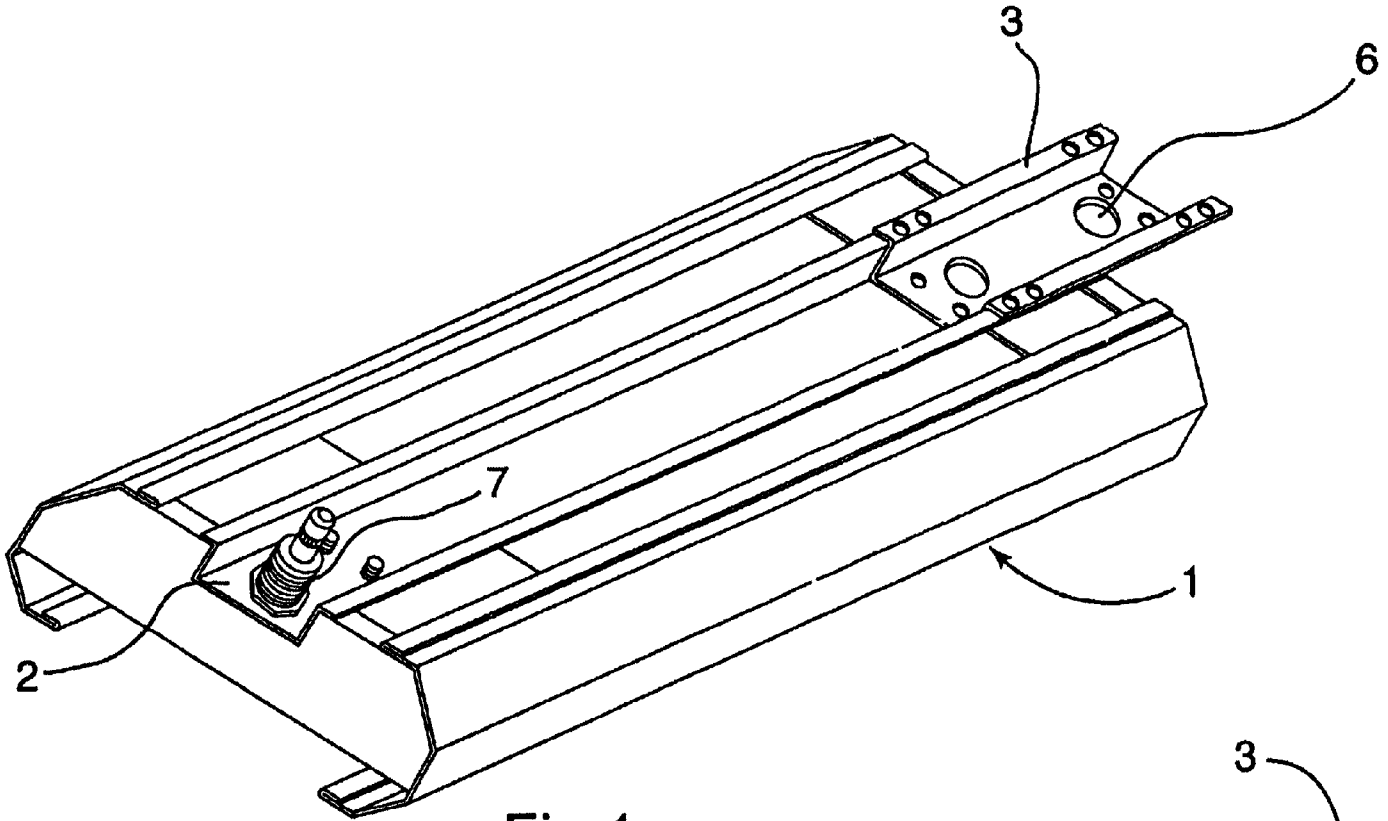
FIG. 1 is a perspective depiction of an illumination assembly according to the teachings of the invention.

As illustrated in the appended drawings and with particular reference to FIG. 1, it is shown a luminaire 1 configured as an elongated, substantially rectangular body, whose configuration and design may vary in different dimensions, as well as in tits configuration per se. Note that in the annexed FIG. 1 as well as in FIG. 3, the upper face of luminaire 1 is provided with a longitudinal chute 2, having an enough depth and width suitable for housing the conduction cables of the electrical fluid, as well as other necessary elements for the electrical energy distribution along with luminaires length disposed in a single illumination line.

As illustrated in the accompanying drawings, the juncture element 3 is permanently mounted in one of the chute 2 ends, the cross section dimensions of the juncture element are such that they allow its mounting over said chute 2. Said juncture element 3 may be or not permanently mounted over one of the chute 2 ends of said luminaire 1, by means of welding or fixing means such as screws, lags or any other suitable fixing elements, the only requirement to meet is that said junture element 3 is reliably and securely mounted on said chute 2. In the event that said fixing element 3 is an independent detachable element of the luminaire, bores 5 are provided in the chute 2, disposed on the flanges of the juncture element 3 or in the base thereof. Therefore, it can be infered that the fixing of the junture element 3 to the chute 2 in a permanent fashion, by means of welding reduces the mounting time for the system, which is an object of the present application.

Figure 2:
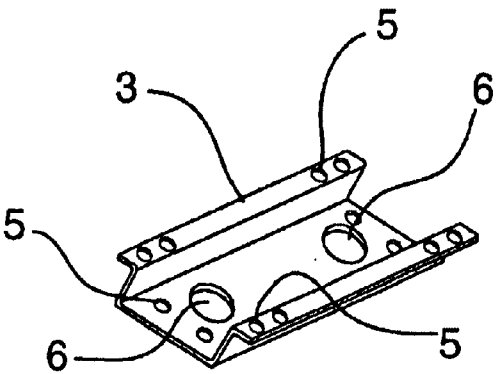
FIG. 2 is a perspective view of a coupling and alignment element found between the adjacent luminaires.

As illustrated in FIG. 2, a separate juncture element 3 is depicted, which shows the juncture element 3 configured as a profile with a channel shape, with two bores 6 in its base which mate with the end bores of chute 2, its purpose is to insert therethrough and permanently fix a coupling or a mechanical device 7, which allows the down cable fixing to the roof structure of the construction, in order to fix the luminaires at a suitable height from the shed structure of the respective construction.

Said junture element 3 has a bores 5 series, which as mentioned above, it is intended to join the adjacent luminaires by means of screws, lags, etc. It is clear that said juncture element 3 can be mounted over the chute 2 of luminaires 1 by means of welding, which avoids the use of screws or lags for this purpose.

Figure 3:
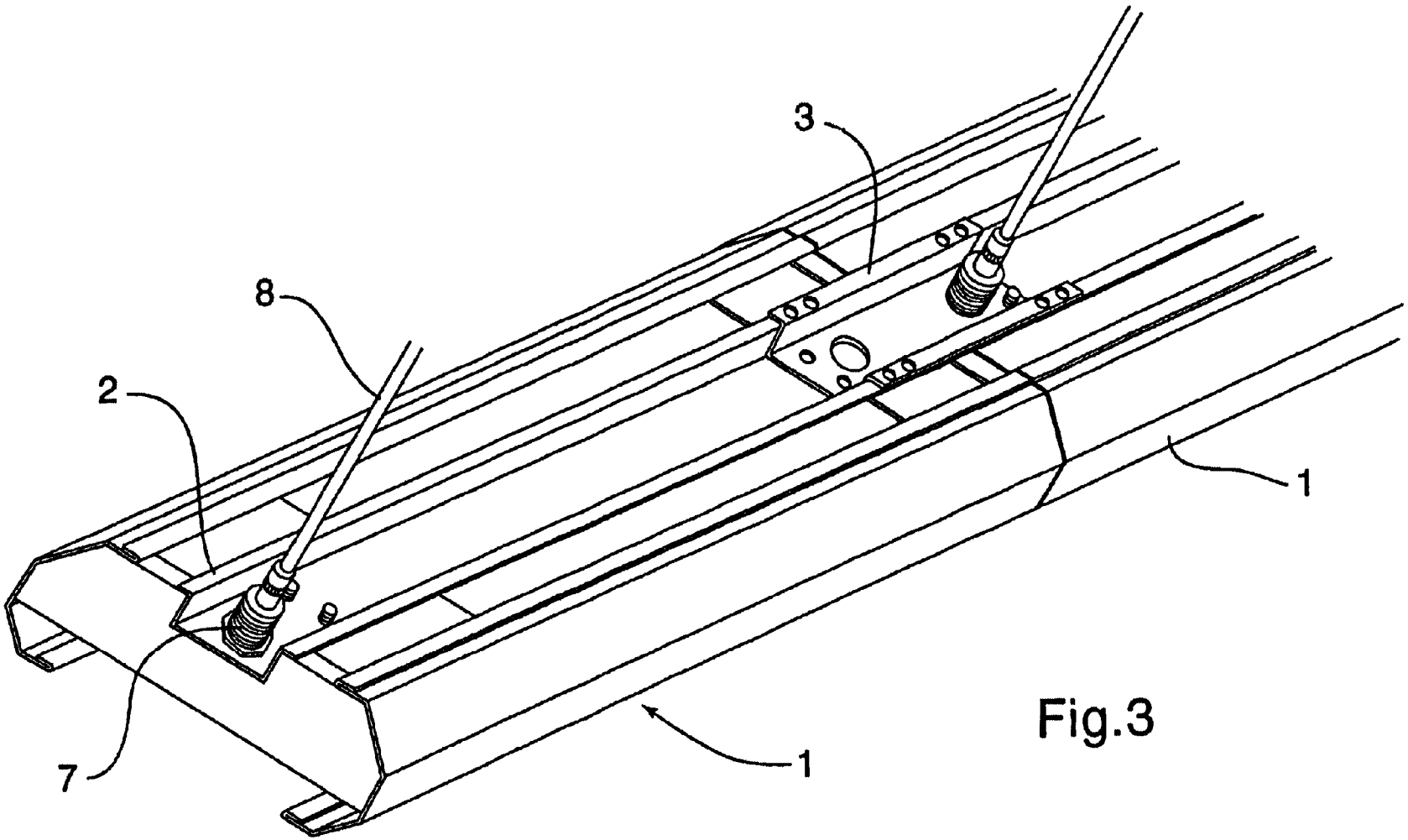
FIG. 3 is a perspective view of two luminaires connected one to each other, according to the teachings of the invention.

With reference to the annexed FIG. 3, two luminaires joined at their ends are shown in a schematic way, the figure shows an exemplary embodiment of the system related to this application. Therefrom, it should be noted that it is required to use a coupling or a mechanical device 7 and a suspension cable 8 for each luminaire, in place of the two currently used.

With the purpose of clarity of the annexed drawings, other kind of common elements for this type of installations have not been shown, such as illumination pipes, electrical ballasts, connectors, among other elements.

The chute 2 and the juncture element 3 allow the disposition and concealing of the electrical cables of the corresponding installation, hence, offering the consumer a cleaner and aesthetically pleasing facility, whilst meeting the applicable security requirements.

It should be noted, that the chute 2 as well as the juncture element 3 may be allocated in the luminaire body in a reverted manner compared with that ilustrated in the appended drawings, and it would represent another embodiment of the invention. Of course, if the purpose is to meet one of the invention objectives, which is to facilitate the design of this kind of installations, it will be obvious that in the aforementioned embodiment, the cables passage through the chute will be greatly impeded.

Although the invention has been described based on the appended drawings, the possibility of using a lid as part of the system, is contemplated. The lid can be hinged, screwed or riveted, concealing the chute 2, in order to provide enough security against a possible cables damage due to a short circuit or any other accident.

The description of this invention should be considered in a wide sense, non restrictive, therefore it is possible to develop certain changes to the aforementioned without departing from the scope and spirit of the invention, all modifications are intended to be covered by the claimed description, as long as they are construed within the spirit and scope of the accompanying claims.

I claim:

1. A suspension, coupling, alignment system and an electrical current cables passage for fluorescent luminaires, comprising a luminaire body provided with a longitudinal chute in its upper face and a juncture element for the mounting of adjacent luminaires, wherein said juncture element has end bores, mating with the bores provided in the lower face of said chute, in order to fix and mount a coupling for the luminaire suspension, said juncture element has a configuration and dimensions such that it can be inserted and permanently mounted on the end parts of said chute.

2. The system according to claim 1, wherein said juncture element is fixed to said chute by means of welding or a fixing means such as screws or pins.

3. The system according to claim 1, wherein said chute as well as the juncture element are mounted on the upper face of said luminaire, such that they form a duct for the electrical cables passage.

4. The system according to claim 1, formed by a luminaires series disposed in tandem, joined and aligned with each other by means of a juncture element with such a configuration and dimensions that it can be allocated in the end parts of said chute.

5. The system according to claim 4, wherein said each luminaire in said tandem is suspended with a single suspension cable to the roof structure of the construction which is to be illuminated.

* * * * *